US007820606B2

(12) United States Patent
Mizusaki et al.

(10) Patent No.: US 7,820,606 B2
(45) Date of Patent: Oct. 26, 2010

(54) LUBRICANT FOR SEWING MACHINES

(75) Inventors: Takashi Mizusaki, Toyonaka (JP); Seiji Hashimoto, Toyonaka (JP); Masato Okabe, Toyonaka (JP)

(73) Assignee: Yamato Mishin Seizo Kabushiki Kaisha, Osaka (JP)

( * ) Notice: Subject to any disclaimer, the term of this patent is extended or adjusted under 35 U.S.C. 154(b) by 961 days.

(21) Appl. No.: 11/531,858

(22) Filed: Sep. 14, 2006

(65) Prior Publication Data

US 2007/0078069 A1 Apr. 5, 2007

(30) Foreign Application Priority Data

Oct. 3, 2005 (JP) ..... 2005-290108

(51) Int. Cl.
*C10M 129/68* (2006.01)
*D05B 71/00* (2006.01)

(52) U.S. Cl. ..... 508/459; 112/256

(58) Field of Classification Search ..... 508/459; 112/256

See application file for complete search history.

(56) References Cited

U.S. PATENT DOCUMENTS 3,928,214 A * 12/1975 Naka et al. ..... 508/123
5,076,339 A * 12/1991 Smith ..... 164/72
6,656,888 B1 * 12/2003 Zehler ..... 508/485

FOREIGN PATENT DOCUMENTS

CN 1598116 A 3/2005
JP 2004-155864 A 6/2004

OTHER PUBLICATIONS

Chinese Office Action mailed Jun. 2, 2010 for the corresponding Chinese Patent Application No. 200610141534.1.

* cited by examiner

*Primary Examiner*—Glenn Caldarola
*Assistant Examiner*—Jim Goloboy
(74) *Attorney, Agent, or Firm*—Leason Ellis LLP

(57) ABSTRACT

A lubricant for sewing machines to be supplied to lubricate a movable part of a sewing machine is formed by using, as main components, a plurality of kinds of synthetic esters combined to have consistency within a range of grade 2 to grade 000 (defined by the NLGI (National Lubricating Grease Institute)) under a temperature of 25° C., and a melting point within a range of 70° C. to 150° C.

7 Claims, No Drawings

LUBRICANT FOR SEWING MACHINES

CROSS-REFERENCE TO RELATED APPLICATION

This non-provisional application claims priority under 35 U.S.C. §119(a) on Patent Application No. 2005-290108 filed in Japan on Oct. 3, 2005, the entire contents of which are hereby incorporated by reference.

BACKGROUND OF THE INVENTION

1. Field of the Invention

The present invention relates to a lubricant for sewing machines, which is used for lubricating movable parts that perform their functions in the respective sections of the sewing machines, and more particularly relates to a lubricant for sewing machines, which is suitably used for lubricating slide parts, such as a needle bar and a looper bar, that slide in an axial direction.

2. Description of Related Art

In recent industrial sewing machines, the operation speed is increased to improve the efficiency of sewing work, and satisfactory lubrication of movable parts existing in the respective sections of the sewing machines is an important objective to realize the high speed operation. As a lubricant for lubricating the movable parts of sewing machines, a sewing machine oil or a grease has been used widely (see, for example, Japanese Patent Application Laid-Open No. 2004-155864).

Lubrication using a sewing machine oil is realized by a lubricating structure in which a housing containing movable parts to be lubricated therein is constructed as a liquid-tightly sealed oil chamber, and the sewing machine oil stored in an appropriate part of the oil chamber is guided to a desired movable part by suitable means, such as circulation by a pump, mechanical raising, or guiding the oil by impregnating an oil core with the oil.

Lubrication using grease is realized by a lubricating structure in which a movable part to be lubricated is provided with a grease sealing section, and the grease sealed in the sealing section beforehand is gradually supplied between the relatively moving surfaces of the movable parts. The sealing section is constructed so that the grease is appropriately supplied from outside and the lubricating performance is maintained in a long time.

BRIEF SUMMARY OF THE INVENTION

As movable parts of a sewing machine to be lubricated as mentioned above, there are slide parts that slide in an axial direction, such as a needle bar and a looper bar. Here, the needle bar is placed so that a middle portion thereof is supported by a support body attached to pass through the lower surface of a sewing machine arm as a housing, and the lower end thereof to which a needle is attached projects downward from the sewing machine arm. The looper bar for moving an upper looper of an overlock sewing machine is placed so that a middle portion thereof is supported by a support body attached to the front surface of a sewing machine bed as the housing, and the upper end thereof to which the upper looper is attached projects outward from the sewing machine bed.

Slide parts of such a needle bar, looper bar and the respective support bodies have high temperatures, particularly in a sewing machine operated at high speeds. Therefore, if the above-mentioned oil lubrication is performed using a sewing machine oil on the slide parts, the sewing machine oil whose viscosity is decreased under high temperatures may leak to the outside via the slide parts and be scattered to the periphery, and may cause problems, such as making a sewn product dirty and deterioration of the working environment of the operator.

Such problems are reduced by employing the lubricating structure using greases. However, when a grease formed in a semi-solid form or a solid form by dispersing a thickener in a lubricant oil is exposed to temperatures exceeding a predetermined temperature (dropping point), it turns into an oil separation state in which the oil component is separated, and the grease from which the oil component is separated will never return to the original state even when the temperature drops thereafter, and thus there is a problem that the function as a grease may be lost in the same part where the oil component is separated. It is thus difficult to apply this structure for long-time stable lubrication of the slide parts of a sewing machine which are expected to have high temperatures exceeding the dropping point in a high-speed operation.

The present invention has been made with the aim of solving the above problems, and it is an object of the invention to provide a lubricant for sewing machines, capable of realizing lubricating performance equal to oil lubrication, without causing problems associated with leakage of the lubricant to the outside, and capable of being suitably used for lubricating movable parts, particularly slide parts, such as a needle bar and a looper bar, of a sewing machine to be operated at high speeds.

A lubricant for sewing machines according to a first aspect of the invention is a lubricant for sewing machines to be supplied to lubricate a movable part of a sewing machine, and characterized by including, as main components, a plurality of kinds of synthetic esters combined to have consistency within a range of grade 2 to grade 000 (defined by the NLGI (National Lubricating Grease Institute)) under a temperature of 25° C., and a melting point within a range of 70° C. to 150° C.

A lubricant for sewing machines according to a second aspect is characterized by including at least one of an antioxidant, a rust inhibitor, a corrosion inhibitor, and a thickener as a sub-component.

A lubricant for sewing machines according to a third aspect is characterized in that each of the plurality of kinds of synthetic esters recited in the first aspect or the second aspect is biodegradable.

A lubricant for sewing machines according to a fourth aspect is characterized in that 60 or less weight % of oil is mixed with the plurality of kinds of synthetic esters recited in the first aspect or the second aspect.

A lubricant for sewing machines according to a fifth aspect is characterized in that 20 to 40 weight % of oil is mixed with the plurality of kinds of synthetic esters recited in the fourth aspect.

Further, a lubricant for sewing machines according to a sixth aspect is characterized in that the oil recited in the fourth aspect is an oil with low viscosity ranging from VG7 to VG100 of ISO viscosity grade numbers.

A lubricant for sewing machines according to a seventh aspect is characterized in that the oil recited in the sixth aspect is an oil with low viscosity ranging from VG22 to VG68 of ISO viscosity grade numbers.

A lubricant for sewing machines according to an eighth aspect is characterized in that the plurality of kinds of synthetic esters recited in the first aspect have consistency within a range of grade 1 to grade 00, and a melting point within a range of 90° C. to 115° C.

Since the lubricants for sewing machines according to the first and eighth aspects of the invention include, as main components, synthetic esters which are in a semi-solid form under ordinary temperatures, liquefied under a supposed internal temperature of a sewing machine during operation and perform the lubricating function, it is possible to suitably place the lubricants in the housing facing the movable parts under ordinary temperatures. Under temperatures during operation, the lubricants are liquefied and can perform satisfactory lubricating function equal to sewing machine oils. Moreover, since the liquefied lubricant returns to a semi-solid form with a decrease in temperature, even if the lubricant leaks to the outside, it is not scattered to the periphery and does not cause problems, such as making the sewn product dirty and deterioration of the working environment.

Moreover, since the lubricant for sewing machines according to the second aspect contains one or a plurality of sub-components, it is possible to realize the individual functions of the respective sub-components, such as prevention of oxidation and prevention of rust, together with satisfactory lubrication. Since the lubricant for sewing machines according to the third aspect is produced by combining biodegradable synthetic esters, even if a part of the lubricant leaked to the outside is scattered, it will disappear by biodegradation, and thus it is possible to certainly prevent occurrence of problems, such as making the sewn product dirty and deterioration of the working environment.

Further, the lubricants for sewing machines according to the fourth and fifth aspects use an appropriate amount of oil mixed with the synthetic esters, and the lubricants for sewing machines according to the sixth and seventh aspects contain an oil with appropriate viscosity. Therefore, by compensating for the transitional lubricating performance with the oil until the synthetic esters are liquefied when staring the operation, it is possible to obtain satisfactory lubricating performance from immediately after the start of operation. The present invention produces such advantageous effects.

The above and further objects and features of the invention will more fully be apparent from the following detailed description.

DETAILED DESCRIPTION OF THE INVENTION

The following description will explain in detail the present invention. In this invention, a synthetic ester is used as a lubricant for lubricating a movable part of a sewing machine. The synthetic ester is a generic name of a compound produced by condensation performed by the action of an alcohol or a phenol on an acid and the separation of water. The synthetic ester has a structure where an acid group and an alkyl group are united by the replacement of a hydrogen atom of the acid with the alkyl group.

"Waxes" existing in the natural world are esters formed by fatty acids and highly monohydric alcohols. Similarly to "waxes", synthetic esters are in a solid form or a semi-solid form under ordinary temperatures. The synthetic esters are liquefied under temperature conditions exceeding the individual melting points, and can exhibit satisfactory lubricating performance.

A lubricant according to the present invention includes, as a main component, a synthetic ester produced by suitably combining a plurality of kinds of synthetic esters to have consistency in a range of grade 2 to grade 000, preferably grade 1 to grade 00 under ordinary temperatures, more specifically under a temperature of 25° C., and have a melting point in a range of 70° C. to 150° C., preferably 90° C. to 115° C.

The consistency is a unit indicting hardness defined by the NLGI (National Lubricating Grease Institute). Synthetic esters combined to have consistency in a range of grade 2 to grade 000, preferably grade 1 to grade 00 are in a semi-solid form, or a so-called paste form, under ordinary temperatures. For example, it is possible to use a holder body, such as a felt and a sponge, to hold the synthetic esters and suitably place the synthetic esters together with the holder body in the housing of a sewing machine accommodating movable parts to be lubricated.

Moreover, synthetic esters combined to have a melting point ranging from 70° C. to 150° C., preferably 90° C. to 115° C. are melted and liquefied under a temperature condition produced in the housing during the operation of the sewing machine, and the liquefied synthetic ester penetrates entirely into the holder body made of a felt, a sponge or the like. Therefore, by arranging a part of the holder body to come into contact with a desired movable part in advance, the synthetic ester is supplied to the movable part and satisfactorily performs the function as a lubricant. The melting point of the synthetic ester can be individually set within a range 70° C. to 150° C., preferably 90° C. to 115° C., according to a supposed temperature in the periphery of the movable part to be lubricated during operation.

Here, synthetic esters differ from greases and have such a characteristic that, after the synthetic esters are liquefied under temperatures exceeding the melting point, they return to the original state as the temperature decreases to the melting point or lower temperatures. Thus, a synthetic ester that is liquefied and performs the above-mentioned lubricating function during operation returns to a semi-solid form with a decrease in temperature after stopping the operation, and maintains the condition being adhered to the movable part, or the condition being held by the holder body, and can repeat exactly the same lubricating function when it is liquefied after starting the operation again.

Like sewing machine oils, a synthetic ester for lubricating a slide part of a needle bar or a looper bar may leak to the outside. However, the leaked synthetic ester in the form of liquid promptly changes into a semi-solid form by contact with the outside air, and remains in the condition being adhered to the surface of the needle bar or looper bar. Therefore, the lubricant according to the present invention has less possibility of being scattered to the periphery during the operation of the sewing machine, and is capable of significantly reducing occurrence of problems, such as making the sewn product dirty and deterioration of the working environment of the operator.

Further, a lubricant for sewing machines according to the present invention may be produced by combining biodegradable synthetic esters to have the above-mentioned consistency and melting point. In this case, even when a part of the leaked synthetic ester is scattered to the periphery, the scattered compound will disappear by biodegradation. Thus, the lubricant adhering to the sewn product will not affect the user, and it is possible to reduce the influence of the scattered compound on the working environment of the operator to a small degree.

A lubricant for sewing machines according to the present invention may be produced by causing synthetic esters as mentioned above to contain one or a plurality of sub-components among an antioxidant, a rust inhibitor, a corrosion inhibitor and a thickener. When an antioxidant is contained as a sub-component, it prevents oxidation of the synthetic esters as main components, and makes it possible to maintain a desired lubricating performance for a long time. When a rust inhibitor is contained as a sub-component, it is possible to lubricate a movable part and it is possible to prevent generation of rust on the movable part simultaneously. When a corrosion inhibitor or a thickener is contained as a sub-component, it is possible to realize the function of each sub-component together with the lubricating function.

A lubricant for sewing machines according to the present invention containing a synthetic ester as a main component may be used by being mixed with a sewing machine oil (oil) that is widely used as a lubricant. By mixing them, initial lubrication is compensated by the sewing machine oil until the synthetic ester reaches the melting point and is liquefied after starting to operate the sewing machine, and it is possible to exhibit the satisfactory lubricating performance from immediately after the start of operation.

A larger mixing amount of sewing machine oil is preferable from the point of view of ensuring the lubricating performance during the initial lubrication. However, when the mixing amount is large, there may be a problem associated with the above-mentioned leakage of the sewing machine oil from the slide part. It was confirmed from the results of various operating tests that it is possible to reduce occurrence of problems associated with leakage by arranging the mixing amount of the sewing machine oil not to be higher than 60 weight %, and further it is possible to realize satisfactory initial lubricating performance and prevent leakage together by setting the mixing amount of sewing machine oil within a range of 20 to 40 weight %.

A lubricant for sewing machines according to the present invention includes a lubricant in which the mixing amount of sewing machine oil is 0%, that is, a lubricant composed only of a synthetic ester as a main component, or a lubricant composed of a synthetic ester having one or a plurality of the above-mentioned sub-components. In this case, an operation period with substantially no lubrication is present at the initial stage of operation until reaching the melting point of the synthetic ester after starting the operation. Therefore, it is desirable to prevent occurrence of initial abrasion and seizure by performing, for example, a hardening process, such as carburizing and quenching, forming a ceramics layer, or forming a diamond-like carbon layer, on the surface of a movable part to be lubricated.

Regarding the sewing machine oil to be mixed, by using a sewing machine oil with low viscosity in a range of VG7 to VG100, preferably in a range of VG22 to VG68 of ISO viscosity grade numbers indicating the viscosity of industrial lubricant oils defined by the International Standards Organization (ISO), it is possible to ensure satisfactory initial lubricating performance, and it is also possible to effectively prevent occurrence of leakage.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A lubricant for sewing machines to be supplied to lubricate a movable part of a sewing machine, including, as main components, an oil and a plurality of kinds of synthetic esters, said plurality of kinds of synthetic esters combined to have consistency within a range of grade 2 to grade 000 (defined by the NLGI (National Lubricating Grease Institute)) under a temperature of 25° C., and a melting point within a range of 70° C. to 150° C., wherein said oil is 60 or less weight % of said lubricant.

2. The lubricant for sewing machines according to claim 1, including at least one of an antioxidant, a rust inhibitor, a corrosion inhibitor, and a thickener as a sub-component.

3. The lubricant for sewing machines according to claim 1, wherein each of said plurality of kinds of synthetic esters is biodegradable.

4. The lubricant for sewing machines according to claim 1, wherein said oil is 20 to 40 weight % of said lubricant.

5. The lubricant for sewing machines according to claim 1, wherein said oil is an oil with low viscosity ranging from VG7 to VG100 of ISO viscosity grade numbers.

6. The lubricant for sewing machines according to claim 5, wherein said oil is an oil with low viscosity ranging from VG22 to VG68 of ISO viscosity grade numbers.

7. The lubricant for sewing machines according to claim 1, wherein said plurality of kinds of synthetic esters have consistency within a range of grade 1 to grade 00, and a melting point within a range of 90° C. to 115° C.

* * * * *